United States Patent [19]

Hayakawa et al.

[11] Patent Number: 4,853,309

[45] Date of Patent: Aug. 1, 1989

[54] PHOTORECEPTOR FOR ELECTROPHOTOGRAPHY WITH A-SI LAYERS HAVING A GRADIENT CONCENTRATION OF DOPED ATOMS AND SANDWICHING THE PHOTOCONDUCTIVE LAYER THEREBETWEEN

[75] Inventors: Takashi Hayakawa, Tenri; Hideo Nojima; Yoshimi Kojima, both of Nara; Shiro Narikawa, Kashihara; Toshiro Matsuyama, Tenri; Eiji Imada; Shaw Ehara, both of Nara, all of Japan

[73] Assignee: Sharp Kabushiki Kaisha, Osaka, Japan

[21] Appl. No.: 204,954

[22] Filed: Jun. 3, 1988

Related U.S. Application Data

[63] Continuation of Ser. No. 838,753, Mar. 12, 1986, abandoned.

[30] Foreign Application Priority Data

Mar. 12, 1985 [JP] Japan ..... 60-49518

[51] Int. Cl.[4] ..... G03G 5/085; G03G 5/10

[52] U.S. Cl. ..... 430/65; 430/66; 430/67; 430/84

[58] Field of Search ..... 430/60, 63, 65, 66, 430/67, 84

[56] References Cited

U.S. PATENT DOCUMENTS

| | | | |
|---|---|---|---|
| 4,394,425 | 7/1983 | Shimizu et al. | 430/60 |
| 4,394,426 | 7/1983 | Shimizu et al. | 430/60 |
| 4,418,132 | 11/1983 | Yamazaki . | |
| 4,460,669 | 7/1984 | Ogawa et al. . | |
| 4,460,670 | 7/1984 | Ogawa et al. . | |
| 4,465,750 | 8/1984 | Ogawa et al. | 430/57 |
| 4,490,453 | 12/1984 | Shirai et al. . | |
| 4,513,073 | 4/1985 | Jeffrey et al. | 430/65 |
| 4,525,442 | 6/1985 | Shirai et al. | 430/66 |

FOREIGN PATENT DOCUMENTS

| | | |
|---|---|---|
| 0039223 | 4/1981 | European Pat. Off. . |
| 0139961 | 8/1984 | European Pat. Off. . |
| 3201081 | 1/1982 | Fed. Rep. of Germany . |
| 58-145951 | 4/1983 | Japan . |
| 58-88753 | 8/1983 | Japan . |
| 60-041046 | 3/1985 | Japan . |

*Primary Examiner*—John L. Goodrow

*Attorney, Agent, or Firm*—Birch, Stewart, Kolasch & Birch

[57] ABSTRACT

A photoreceptor for electrophotography including an electrically conductive substrate, a bottom layer, a photoconductive layer composed mainly of amorphous silicon, and a surface layer, in that order. Both the bottom and surface layers have a greater optical bandgap than said photoconductive layer. A first middle layer is disposed between said bottom layer and said photoconductive layer, and a second middle layer is disposed between said photoconductive layer and said surface layer. Both the first and second middle layers are composed mainly of amorphous silicon and have a concentration of doped atoms which varies from the bottom to the top of the layer.

26 Claims, 2 Drawing Sheets

PHOTORECEPTOR FOR ELECTROPHOTOGRAPHY WITH A-SI LAYERS HAVING A GRADIENT CONCENTRATION OF DOPED ATOMS AND SANDWICHING THE PHOTOCONDUCTIVE LAYER THEREBETWEEN

This application is a continuation of application Ser. No. 838,753 filed on Mar. 12, 1986, now abandoned.

BACKGROUND OF THE INVENTION

1. Field of the Invention

This invention relates to a photoreceptor for electrophotography which comprises a photoconductive layer composed mainly of amorphous silicon.

2. Description of the Prior Art

In photoreceptors provided for electrophotography presently in practical use, a combination of high resistance and high sensitivity is a basic requirement. As a material having such a combination of characteristics, a resin dispersal material in which cadmium sulfide powder is dispersed into an organic resin and an amorphous material such as amorphous selenium (a-Se) or amorphous arsenious selenide (a-$As_2Se_3$) have been most often used. However, all such materials cause pollution, so the development of a substitute material is desirable. In recent years, amorphous silicon has gained prominence as a different material for the above-mentioned photoreceptors.

In addition to its not causing pollution and its having high sensitivity, this substance is also extremely hard, and it is expected to be a superior material for use in photoreceptors. However, amorphous silicon by itself does not have enough resistance to maintain the electrostatic charge necessary during the procedures of electrophotography. Therefore, in order to use amorphous silicon as a photoreceptor for electrophotography, a means by which a large electrostatic potential can be maintained with high sensitivity is necessary.

As one such means, it has been proposed to bring about high resistance in the amorphous silicon layer itself which is to become a photoreceptor. However, in order to efficiently use the superior photoconductive characteristics of amorphous silicon (including its strong optical absorbance, relatively large drift mobility of electrons and positive holes, its sensitivity to long wavelengths, etc.), it would be better to provide a blocking layer having a great energy bandgap on the surface of each of the amorphous silicon layers (i.e., on the photoconductive layer) and the substrate rather than to enhance the capacity to be charged with electricity by bringing about high resistance in the photoconductive layer itself, as has been mentioned. This kind of surface layer with a great energy bandgap does not only hold an electrostatic charge, but also protects the photoreceptor from strong corona shock arising during the process of electrophotography. Such a surface layer also acts as a protective film which minimizes changes in the characteristics of the photoreceptor caused by changes in the environment (in temperature, humidity, etc.) so as to stabilize the surface of the photoreceptor; such a protective surface layer is indispensable. Of course, for it to act as a protective surface layer, a great energy bandgap is desirable for this layer.

As mentioned above, the provision of the surface layer having a great energy bandgap is desirable in that not only can an electrostatic charge be effectively held on the photoconductive layer, but also the surface of the photoconductive layer can be protected. However, when a surface layer with a great energy bandgap is formed directly on the amorphous silicon layer which is a photoconductive layer, various phenomena appear that are undesirable in a photoreceptor for electrophotography.

One such phenomenon is mechanical instability. When a photoconductive layer of amorphous silicon is constructed with a surface layer having a great energy gap, the binding between the photoconductive layer and the surface layer is not stable due to a difference in the coefficient of thermal expansion therebetween, and they tend to peel away from each other.

Another phenomenon is deterioration in the electrical characteristics of the photoreceptor. That is, during the process of electrophotography, when a photoreceptor, the surface layer of which has been already electrically charged, is illuminated, the light causes an electric charge on the photoreceptor with a different polarity from the charging polarity of the electric charge on the surface layer. The electric charge on the photoconductive layer then moves through the surface layer to neutralize electrostatically the electric charge on the surface layer. However, the energy bandgap of the surface layer is so large that there is an extremely great energy gap at the interface between the photoconductive layer and the surface layer, and smooth transfer of the electric charge does not take place. Instead, the electric charge builds up in the vicinity of the interface between the surface layer and the photoconductive layer, resulting in a residual potential. Such a residual potential is undesirable, and if it increases, it can cause deterioration in the characteristics of the photoreceptor.

Moreover, residual potential frequently gives rise to movement of the accumulated carriers in the horizontal direction of the photoreceptor, which causes the problem known as image blurring.

As mentioned above, a surface layer with a great energy bandgap is essential because it holds the electric charge and protects the surface of the photoconductive layer, but it causes incidental problems both mechanically and electrically. This means that a satisfactory photoreceptor made of amorphous silicon has not yet been achieved.

Moreover, in order to prevent the injection of an electric charge from the substrate to the photoconductive layer, it is preferable to form a bottom layer with a great optical bandgap on the bottom of the photoconductive layer which faces the substrate, in the same manner as in the surface layer with a great optical bandgap.

However, because of the lack of mechanical matching, it is difficult to form a photoconductive layer, which does not incorporate any nitrogen (N) or carbon (C) directly, with a thickness of, for example, 8 $\mu$m or more on the bottom layer.

If an amorphous silicon membrane which does not include any boron is used as the photoconductive layer, it is not suitable for use as a photoconductive layer when positively charged because of a number of difficulties: the resistance is small, the capacity to be charged with electricity cannot be large, and the transport capacity (mobility-carrier life time product) of positive holes is poor.

SUMMARY OF THE INVENTION

The photoreceptor for electrophotography of this invention overcomes the above-discussed and numerous other disadvantages and deficiencies of the prior art and comprises an electrically conductive substrate, a bottom layer, a photoconductive layer composed mainly of amorphous silicon, and a surface layer, in that order, both the bottom and surface layers having a greater optical bandgap than said photoconductive layer, wherein a first middle layer is disposed between said bottom layer and said photoconductive layer, and a second middle layer is disposed between said photoconductive layer and said surface layer, both the first and second middle layers being composed mainly of amorphous silicon and having a varied distribution of concentrations of doped atoms from the bottom to the top of the layer.

The photoconductive layer contains, in a preferred embodiment, boron, the concentration of which is not uniform therethrough from the bottom to the top of the layer.

The surface layer and the bottom layer are, in a preferred embodiment, composed of amorphous silicon nitride or amorphous silicon carbide. When the surface layer and the bottom layer are composed of amorphous silicon nitride, in a preferred embodiment, the first and second middle layers contain nitrogen and boron as doped atoms, the concentrations of which are not uniform therethrough from the bottom to the top of the layer. Alternatively, when the surface layer and the bottom layer are composed of amorphous silicon carbide, in a preferred embodiment, the first and second middle layers contain carbon and boron as doped atoms, the concentrations of which are not uniform therethrough from the bottom to the top of the layer.

Thus, the invention described herein makes possible the objects of (1) providing a photoreceptor for electrophotography which produces a good early phase image having especially excellent contrast; and (2) providing a photoreceptor for electrophotography which can make a number of copies (e.g., 300,000 copies) with an excellent quality image which is equal to that at the early-phase.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

Figure 1:
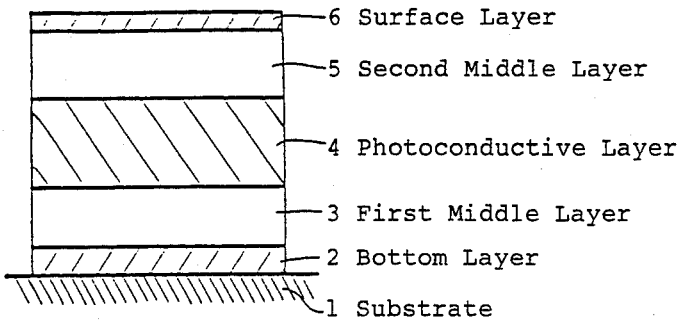
FIG. 1 is a cross-sectional view showing the structure of a photoreceptor for electrophotography of this invention.

FIG. 1 shows a photoreceptor for electrophotography of this invention which comprises an electrically conductive substrate 1, a bottom layer 2, a first middle layer 3, a photoconductive layer 4, a second middle layer 5, and a surface layer 6, in that order. To prevent the injection of an electric charge from the substrate 1 to the photoconductive layer 4, the bottom layer 2, which is composed of amorphous silicon nitride (a-$Si_{1-x}N_x$) or amorphous silicon carbide (a-$Si_{1-x}C_x$) and which has a greater optical bandgap that the photoconductive layer 4, is disposed on the substrate 1. In order to achieve electrical and mechanical matching between the bottom layer 2 and the photoconductive layer 4, which does not contain any nitrogen (N), carbon (C), etc., the first middle layer 3 composed of boron-doped amorphous silicon containing nitrogen (N) or carbon (C) is disposed therebetween in such a manner that the concentration of the N, C, and B are not uniform therethrough in the vertical direction (i.e., from the bottom to the top of the layer). In order to increase the capacity to be charged with electricity of the photoreceptor and the photo-sensitivity thereof, the photoconductive layer 4 is constructed so as to incorporate boron, the concentration of which is not uniform therethrough from the bottom to the top of the layer.

Moreover, in order to increase the capacity to be charged with electricity of the photoreceptor and to enlarge the life span thereof, the surface layer 6, which is composed of a-$Si_{1-x}N_x$ or a-$Si_{1-x}C_x$ and which has a greater optical bandgap than the photoconductive layer 4, is placed on the upper portion of the photoreceptor. To achieve electrical and mechanical matching between the photoconductive layer 4 and the surface layer 6, the second middle layer 5 composed of boron-doped amorphous silicon containing N or C is disposed therebetween in such a manner that the concentrations of the N or C, and the B are not uniform therethrough from the bottom to the top of the layer.

With the above-mentioned structure, a photoreceptor for electrophotography which produces a good early phase image with especially excellent contrast and which can make a number of copies (e.g., 300,000 copies) with an excellent image which is equal to the images produced in the early phase can be obtained.

EXAMPLE

The photoreceptor for electrophotography of this invention shown in FIG. 1 is produced by the following process, in which nitrogen is incorporated into the first and second middle layers 3 and 5, the bottom layer 2, and the surface layer 6.

A-Si constituting the photoconductive layer and other layers is prepared by treating monosilane gas ($SiH_4$) to glow-discharge decomposition (e.g., plasma chemical vapor deposition) by means of an inductive-coupling apparatus in a reaction chamber in which the electrically conductive substrate on which the photoconductive layer will be formed is electrically grounded, and a high-frequency electrical power is applied to the coil through an impedance-matching circuit. The reaction gas is allowed to flow into the reaction chamber at a controlled flow rate, and the electrically conductive substrate placed in the reaction chamber is kept at 200°-300° C. (e.g., 250° C.).

First, the bottom layer 2 made of amorphous silicon nitride with a thickness of, for example, 0.15 μm, is formed on the electrically conductive substrate 1 under the membrane-formation conditions shown in Table 1.

TABLE 1

| Bottom Layer | |
|---|---|
| $SiH_4$ flow rate (sccm) | 28 |
| $NH_3$ flow rate (sccm) | 100 |
| $B_2H_6$ (0.3% in $H_2$) flow rate (sccm) | 0 |
| R.F. Power (W) | 30 |
| Pressure (torr) | 0.4 |
| Substrate Temperature (°C.) | 250 |

Next, the first middle layer 3 composed mainly of amorphous silicon with a thickness of, for example, 1.5 μm, is formed on the bottom layer 2 under the membrane-formation conditions shown in Table 2, wherein this first middle layer 3 is formed such that the concentrations of the nitrogen and boron are not uniform therethrough from the bottom to the top of the layer by changing the $NH_3$ flow rate from 12 sccm to 0 sccm and the $B_2H_6$ flow rate from 50 sccm to 0.09 sccm either continuously or in a stepwise fashion.

TABLE 2

| First Middle Layer | |
|---|---|
| $SiH_4$ flow rate (sccm) | 60 |
| $NH_3$ flow rate (sccm) | 12→0 |
| $B_2H_6$ (0.3% in $H_2$) flow rate (sccm) | 50→0.09 |
| R.F. Power (W) | 100 |
| Pressure (torr) | 0.25 |
| Substrate Tempeature (°C.) | 250 |

Next, the photoconductive layer 4 composed mainly of amorphous silicon with a thickness of, for example, 20–30 μm, is formed on the first middle layer 3 under the membrane-formation conditions shown in Table 3, wherein this photoconductive layer 4 is formed such that the concentration of boron is not be uniform therethrough from the bottom to the top of the layer by changing the $B_2H_6$ flow rate from 0.12 sccm to 0 sccm either continuously or in a stepwise fashion.

TABLE 3

| Photoconductive Layer | |
|---|---|
| $SiH_4$ flow rate (sccm) | 80 |
| $NH_3$ flow rate (sccm) | 0 |
| $B_2H_6$ (0.3% in $H_2$) flow rate (sccm) | 0.12→0 |
| R.F. Power (W) | 200 |
| Pressure (torr) | 0.25 |
| Substrate Temperature (°C.) | 250 |

Next, the second middle layer 5 composed mainly of amorphous silicon with a thickness, for example, 1.5 μm is formed on the photoconductive layer 4 under the membrane-formation conditions shown in Table 4, wherein this second middle layer 5 is formed such that the concentrations of nitrogen and boron are not be uniform therethrough from the bottom to the top of the layer by changing the $NH_3$ flow rate from 0 sccm to 12 sccm and the $B_2H_6$ flow rate from 0 sccm to 50 sccm either continuously or in a stepwise fashion.

TABLE 4

| Second Middle Layer | |
|---|---|
| $SiH_4$ flow rate (sccm) | 60 |
| $NH_3$ flow rate (sccm) | 0→12 |
| $B_2H_6$ (0.3% in $H_2$) flow rate (sccm) | 0→50 |
| R.F. Power (W) | 100 |
| Pressure (torr) | 0.25 |
| Substrate Temperature (°C.) | 250 |

Next, the surface layer 6 composed of amorphous silicon nitride with a thickness of, for example, 0.15 μm, is formed on the second middle layer 5 under the membrane-formation conditions shown in Table 5.

TABLE 5

| Surface Layer | |
|---|---|
| $SiH_4$ flow rate (sccm) | 28 |
| $NH_3$ flow rate (sccm) | 50 |
| $B_2H_6$ (0.3% in $H_2$) flow rate (sccm) | 0 |
| R.F. Power (W) | 30 |
| Pressure (torr) | 0.4 |

TABLE 5-continued

| Surface Layer | |
|---|---|
| Substrate Temperature (°C.) | 250 |

Examples of the distribution of the concentrations of nitrogen and boron in the different layers of a photoreceptor for electrophotography constructed as described above are shown in FIGS. 2(*a*)–2(*c*), wherein the ordinate gives the distance from the substrate 1, and the abscissa gives the concentrations of nitrogen and boron. The solid line gives the concentration of nitrogen to be dopef. The concentration is indicated with the order of a few percents by the atomic ratio of N to Si. The broken line gives the concentration of boron to be doped. The concentration is indicated with the order of ppm by the atomic ratio of B to Si.

Figure 2A:
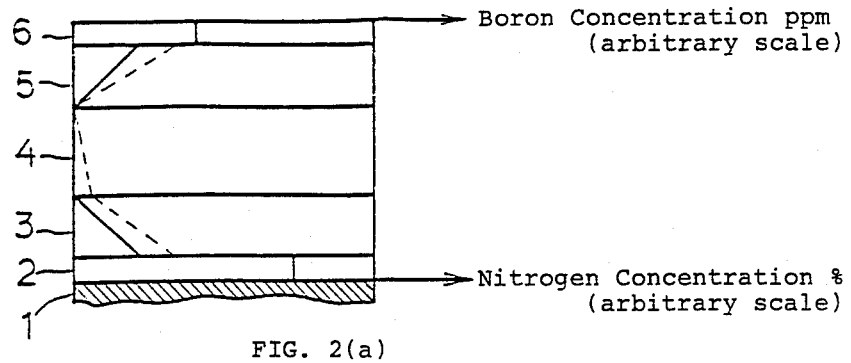
FIGS. 2(*a*), 2(*b*) and 2(*c*), respectively, are schematic diagrams showing the concentrations of nitrogen atom and boron atom contained in each of the layers constituting the photoreceptor of electrophotography shown in FIG. 1.
Figure 2B:
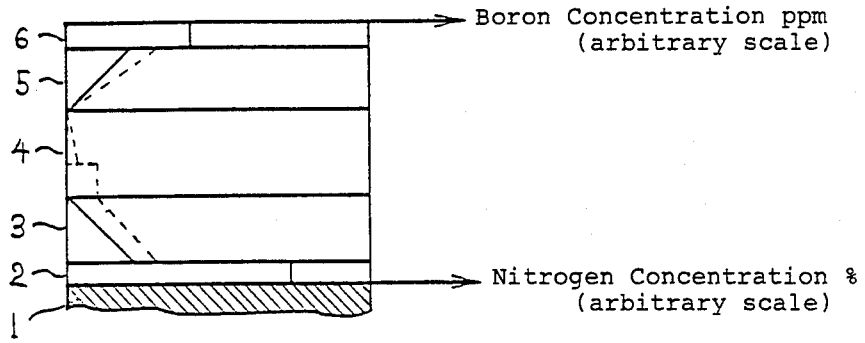
Figure 2C:
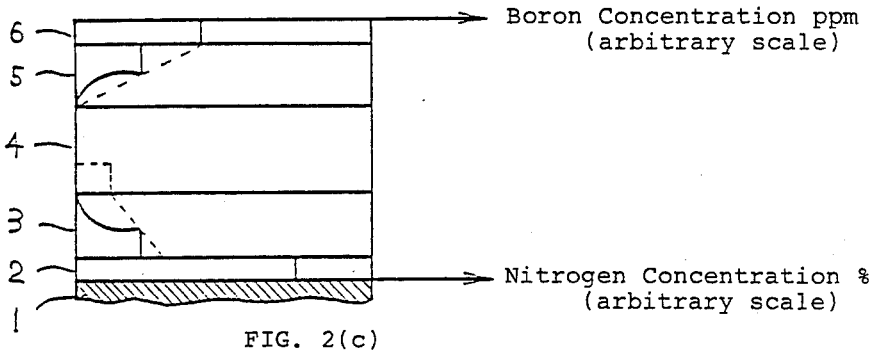

FIG. 2(*a*) indicates that the concentrations of nitrogen and boron in the first middle layer 3 are both decreased continuously toward the direction of the surface, that the concentration of boron in the photoconductive layer 4 is decreased continuously toward the direction of the surface, and that the nitrogen and boron concentrations of the second middle layer 5 are increased continuously toward the direction of the surface. FIG. 2(*b*) is different from FIG. 2(*a*) in that the concentratoion of boron is changed in photoconductive layer 4 stepwise. FIG. 2(*c*) is different from FIG. 2(*a*) in that the nitrogen concentration of the first and second middle layers 3 and 5 is changed in one place stepwise, and the boron concentration of the photoconductive layer 4 is changed stepwise, as well.

The photoreceptor for electrophotography produced by the above-mentioned process was then incorporated into a copying machine which was already in practical use. The resulting image was excellent in contrast, resolution, and tone reproduction compared to an image produced by conventional photoreceptors for electrophotography. Moreover, the defects of blurring and white patches of the image hardly arose. Such satisfactory results have not been obtained by conventional photoreceptors for electrophotography. In particular, the contrast of an image resulting from the photoreceptor for electrophotography of this invention was excellent compared to that of an image resulting from conventional photoreceotors. That is, the photoreceptor of this invention having a photoconductive layer with a changing boron concentration attained excellent contrast of images compared to conventional photoreceptors having a photoconductive layer with a uniform boron concentration. Moreover, the photoreceptor for electrophotography of this invention which has changing concentrations of nitrogen and boron from the bottom to the top of the layer was much improved in terms of image defects compared to conventional photoreceptors for electrophotography in which the first and second middle layers are not provided, or even compared to photoreceptors having the first and second middle layers with uniform concentrations of nitrogen and boron from the bottom to the top of the layer. Thus, the existence of middle layers with a varied distribution of concentrations is important to prevent image defects.

The photoreceptor for electrophotography of this invention was studied in a copy test to make 300,000 copies using an actual copy machine. Even after 300,000 copies were made, an excellent quality image which was equal to that at the early phase was obtained. However, in a copy test of a conventional photoreceptor for electrophotography without a surface layer and a bottom layer, a number of image defects (including a lowering of contrast, blurring, and white patches) appeared at an early stage, after 10,000 copies were made. Thus, the provision of a surface layer and a bottom layer having great optical bandgap achieves good results.

The above-mentioned example discloses a photoreceptor in which nitrogen is contained in the first and second middle layers 3 and 5, the bottom layer 2, and the surface layer 6, but it is not limited thereto. Each of the layers can be composed of amorphous silicon carbide containing carbon.

The above-mentioned example discloses the formation of each of the layers using a glow discharge decomposition technique, but it is not limited thereto. This invention is, of course, applicable to a photoreceptor for electrophotography which is produced using a membrane-formation method such as sputtering, etc.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty which residue in the present invention, including all features which would be treated as equivalents thereof by those skilled in the art to which this invention pertains.

What is claimed is:

1. A photoreceptor for electrophotography comprising an electrically conductive substrate, a bottom layer, a photoconductive layer composed mainly of amorphous silicon, and a surface layer, in that order, both the bottom and surface layers having a greater optical bandgap than said photoconductive layer, wherein a first middle layer is disposed between said bottom layer and said photoconductive layer, and a second middle layer is disposed between said photoconductive layer and said surface layer, both the first and second middle layers being composed mainly of amorphous silicon and having a varied distribution of concentrations of doped atoms from the bottom to the top of the layer.

2. A photoreceptor for electrophotography according to claim 1, wherein said photoconductive layer contains boron, the concentration of which is not uniform therethrough from the bottom to the top of the layer.

3. A photoreceptor for electrophotography according to claim 1, wherein said surface layer and said bottom layer are composed of amorphous silicon nitride or amorphous silicon carbide.

4. A photoreceptor for electrophotography according to claim 3, wherein said surface layer and said bottom layer are composed of amorphous silicon nitride, and said first and second middle layers contain nitrogen and boron as doped atoms, the concentrations of which are not uniform therethrough from the bottom to the top of the layer.

5. A photoreceptor for electrophotography according to claim 3, wherein said surface layer and said bottom layer are composed of amorphous silicon carbide, and said first and second middle layers contain carbon and boron as doped atoms, the concentrations of which are not uniform therethrough from the bottom to the top of the layer.

6. A photoreceptor for electrophotography according to claim 2, wherein said surface layer and said bottom layer are composed of amorphous silicon nitride or amorphous silicon carbide.

7. A photoreceptor for electrophotography comprising:

an electrically conductive substrate;

a bottom layer disposed on said substrate;

a first middle layer disposed on said bottom layer;

a photoconductive layer composed mainly of amorphous silicon disposed over said first middle layer;

a second middle layer disposed over said photoconductive layer; and a surface layer disposed over said second middle layer;

said bottom layer and said surface layer having a greater optical bandgap than said photoconductive layer;

said first and second middle layer being composed mainly of amorphous silicon with doped atoms, the concentration of doped atoms in each of said middle layers varying with the distance within said layer from said photoconductive layer.

8. The photoreceptor of claim 7, wherein said photoconductive layer includes a concentration of doped atoms which varies as the distance from said second middle layer increases.

9. The photoreceptor of claim 8, wherein the doped atoms in said photoconductive layer comprise boron, the concentration of boron increasing with increasing distance from said second middle layer.

10. A photoreceptor for electrophotography according to claim 2, wherein said surface layer and said bottom layer are composed of amorphous silicon nitride or amorphous silicon carbide.

11. A photoreceptor for electrophotography according to claim 7, wherein said surface layer and said bottom layer are composed of amorphous silicon nitride or amorphous silicon carbide.

12. A photoreceptor for electrophotography according to claim 8, wherein said surface layer and said bottom layer are composed of amorphous silicon nitride or amorphous silicon carbide.

13. The photoreceptor of claim 8, wherein the doped atoms in said photoconductive layer comprise boron;

said surface layer and said bottom layer being composed of amorphous silicon nitride;

said first and second middle layers containing nitrogen and boron as doped atoms.

14. The photoreceptor of claim 13, wherein the concentration of nitrogen and boron in each of said first and second middle layers increases as the distance from said photoconductive layer increases.

15. The photoreceptor of claim 8, wherein the doped atoms in said photoconductive layer comprise boron;

said surface layer and said bottom layer being composed of amorphous silicon carbide;

said first and second middle layers containing carbon and boron as doped atoms.

16. The photoreceptor of claim 15, wherein the concentration of carbon and boron in each of said first and second middle layers increases as the distance from said photoconductive layer increases.

17. The photoreceptor of claim 9, wherein the doped atoms in said first and second middle layer comprise (1) boron and (2) nitrogen or carbon, and wherein said photoconductive layer, said first middle layer and said second middle layer are prepared by a glow-discharge decomposition method, a plasma chemical vapor deposition method, a membrane-formation method, or a sputtering technique.

18. The photoreceptor of claim 17, wherein the doped atoms in said first and second middle layer comprise boron and nitrogen, and wherein said photoconductive layer, said first middle layer and said second middle layer are prepared under membrane-formation conditions during which boron and nitrogen gas flow rates are changed continuously or in a stepwise fashion so as to vary the concentration of boron and nitrogen doped atoms.

19. The photoreceptor of claim 10, wherein the doped atoms in said first and second middle layer comprise (1) boron and (2) nitrogen or carbon, and wherein said photoconductive layer, said first middle layer and said second middle layer are prepared by a glow-discharge decompositon method, a plasma chemical vapor deposition method, a membrane-formation method, or a sputtering technique.

20. The photoreceptor of claim 19, wherein the doped atoms in said first and second middle layer comprise boron and nitrogen, and wherein said photoconductive layer, said first middle layer and said second middle layer are prepared under membrane-formation conditions during which boron and nitrogen gas flow rates are changed continuously or in a stepwise fashion so as to vary the concentration of boron and nitrogen doped atoms.

21. The photoreceptor of claim 14, wherein the concentration of boron in said photoconductive layer continuously increases with increasing distance from said second middle layer.

22. The photoreceptor of claim 14, wherein the concentration of boron in said photoconductive layer increases in a stepwise manner with increasing distance from said second middle layer.

23. The photoreceptor of claim 16, wherein the concentration of boron in said photoconductive layer continuously increases with increasing distance from said second middle layer.

24. The photoreceptor of claim 16, wherein the concentration of boron in said photoconductive layer increases in a stepwise manner with increasing distance from said second middle layer.

25. The photoreceptor of claim 22, wherein the concentration of nitrogen increases in a stepwise manner and the concentration of boron increases in a continuous manner in each of said first and second middle layers as the distance from said photoconductive layer increases.

26. The photoreceptor of claim 24, wherein the concentration of nitrogen increases in a stepwise manner and the concentration of boron increases in a continuous manner in each of said first and second middle layers as the distance from said photoconductive layer increases.

* * * * *